US010340641B2

(12) United States Patent
Loske et al.

(10) Patent No.: US 10,340,641 B2
(45) Date of Patent: Jul. 2, 2019

(54) DEVICE FOR TRANSMITTING DATA

(71) Applicant: HARTING ELECTRIC GMBH & CO. KG, Espelkamp (DE)

(72) Inventors: Felix Loske, Lotte (DE); Christian Vollmer, Herford (DE); Lutz Troeger, Osnabrueck (DE)

(73) Assignee: HARTING ELECTRIC GMBH & CO. KG (DE)

( * ) Notice: Subject to any disclaimer, the term of this patent is extended or adjusted under 35 U.S.C. 154(b) by 0 days.

(21) Appl. No.: 15/761,747

(22) PCT Filed: Oct. 4, 2016

(86) PCT No.: PCT/DE2016/100462
§ 371 (c)(1),
(2) Date: Mar. 20, 2018

(87) PCT Pub. No.: WO2017/059843
PCT Pub. Date: Apr. 13, 2017

(65) Prior Publication Data

US 2018/0277996 A1 Sep. 27, 2018

(30) Foreign Application Priority Data

Oct. 6, 2015 (DE) ..... 10 2015 116 927

(51) Int. Cl.
*H01R 13/66* (2006.01)
*H01R 13/512* (2006.01)
(Continued)

(52) U.S. Cl.
CPC ..... *H01R 13/6691* (2013.01); *H01R 13/512* (2013.01); *H01R 13/59* (2013.01); *H01R 13/665* (2013.01); *H01R 31/06* (2013.01)

(58) Field of Classification Search
CPC ..... H01R 13/6691; H01R 13/665
See application file for complete search history.

(56) References Cited

U.S. PATENT DOCUMENTS 7,322,842 B2 1/2008 Dück et al. ..... 439/289
7,988,476 B2 * 8/2011 Billman ..... H01R 13/622 439/271
(Continued)

FOREIGN PATENT DOCUMENTS

DE 19851473 5/2000 ..... G05B 19/04
DE 20219875 5/2004 ..... H01R 13/66
(Continued)

OTHER PUBLICATIONS

German Search Report (w/machine translation) issued in application No. 10 2015 116 927.4, dated Jun. 9, 2016 (10 pgs).
(Continued)

*Primary Examiner* — Ross N Gushi
(74) *Attorney, Agent, or Firm* — Hayes Soloway P.C.

(57) ABSTRACT

A device for data transmission from a plug connector housing includes a data module for storing and forwarding data, a plug connector housing with a cable outlet opening and a threaded cable connection, and an adapter module which has at least one cable passage area. The adapter module has a cable inlet opening on a first end of this cable passage area and a cable outlet opening on a second end of this cable passage area, wherein the adapter module can be fastened with its cable inlet opening on the cable outlet opening of the plug connector housing, and the threaded cable connection can be fastened to the cable outlet opening of the adapter module so that the adapter module can be fastened between the cable outlet opening and the threaded cable connection.

16 Claims, 5 Drawing Sheets

(51) Int. Cl.
*H01R 13/59* (2006.01)
*H01R 31/06* (2006.01)

(56) References Cited

U.S. PATENT DOCUMENTS

| | | | | |
|---|---|---|---|---|
| 8,262,406 | B2 | 9/2012 | Lindkamp | 439/470 |
| 2007/0164704 | A1 | 7/2007 | McGinley et al. | 320/114 |
| 2008/0052439 | A1 * | 2/2008 | Young | G06F 13/4027 710/305 |
| 2013/0296729 | A1 | 11/2013 | Datta | A61B 18/1492 |
| 2015/0199603 | A1 | 7/2015 | Troeger et al. | G06K 19/07758 |

FOREIGN PATENT DOCUMENTS

| | | | |
|---|---|---|---|
| DE | 102006030077 | 1/2008 | H01R 13/645 |
| DE | 102009053364 | 1/2011 | H01R 13/58 |
| EP | 1353412 | 10/2003 | G02B 6/38 |
| EP | 2182593 | 5/2010 | H01R 13/66 |

OTHER PUBLICATIONS

International Preliminary Report on Patentability (w/translation) issued in application PCT/DE2016/100462, dated Apr. 10, 2018 (13 pgs).
International Search Report (w/translation) and Written Opinion (no translation) issued in application No. PCT/DE2016/100462, dated Jan. 26, 2017 (10 pgs).

* cited by examiner

DEVICE FOR TRANSMITTING DATA

BACKGROUND OF THE INVENTION

The invention relates to a device for data transmission.

Devices of this type are required by way of example for storing measurement data or other data in or on a plug connector and for transmitting said data to the environment.

DESCRIPTION OF THE PRIOR ART

It is known in the prior art to integrate data modules into plug connectors. Generally, a plug connector has the function of transmitting energy, for example electrical and/or pneumatic energy, and in addition or as an alternative thereto the function of transmitting signals, for example electrical and/or optical signals. A plug connector is able to use a data module in addition to this conventional function to also store data and if necessary to transmit said data to the environment. The term 'data module' generally describes a separate component that is able to store and transmit this data.

Data modules that may be integrated into a plug connector are known in the prior art by way of example from the publications D 198 51 473 A1 and EP 1 353 412 B1.

Furthermore, it is known from the publication DE 202 19 875 U1 to integrate a corresponding storage module having a USE connector into a plug connector.

This prior art has the disadvantage that all these modules are only able to communicate via the cable that is conventionally connected to the plug connector, as a result of which the onward signal transmission of the data is fixed by means of the path of the cable. However, the path of this cable is generally predetermined by means of the conventional function of the plug connector.

Moreover, it is also known from the publication US 2015/0199603 A1 to integrate an RFID transponder into a plug connector housing.

However, this has the disadvantage that it is necessary for the associated plug connector housings to be embodied from a non-shielding, in particular non-metal material, in order not to impair the corresponding radio traffic. Conversely, it is necessary to provide shielding housings for numerous plug connectors. Furthermore, it is not possible or only possible with difficulty inter alia for reasons of stability to replace metal as a material.

It is in addition known to use an RFID transponder as a data module and to fasten it, for example adhere it, to an outer face of a metal housing of the plug connector. There is however the danger that the RFID tags fall off when subjected to extreme environmental conditions and possibly become lost. Although transponders that are attached from the outside to a metal housing are naturally well suited by way of example for identification purposes, they are however not suitable for performing measurements that are taken within the plug connector housing, for example measurements relating to temperature, current, voltage, conductivity and/or humidity and also in addition or as an alternative thereto are not suitable for performing comprehensive function tests. However, it is such measurement data and their real time analysis that are becoming more important with regard to analyzing the signal transmission.

The prior art therefore requires a device that renders it possible to make data from a plug connector housing available irrespective of its conventional cabling.

OBJECT OF THE INVENTION

The object of the invention is thus to provide a device that renders it possible for the data transmission from a plug connector housing to be configured as freely as possible. In particular, it is in addition an object of the invention if necessary to also maintain the shielding effect of the plug connector housing that is by way of example metal.

SUMMARY OF THE INVENTION

This device for data transmission comprises a data module for storing and playing back data, and also a plug connector housing having a cable outlet opening and a cable gland and furthermore an adapter module that comprises at least one cable passage region and comprises a cable inlet opening at a first end of the cable passage region and a cable outlet opening at a second end of this cable passage region, wherein the adaptor module may be fastened by means of its cable inlet opening to the cable outlet opening of the plug connector housing, and wherein the cable gland may be fastened to the cable outlet opening of the adaptor module, with the result that the adaptor module may be fastened between the cable outlet opening and the cable gland.

An essential advantage of the invention resides in the fact that it is possible to arrange the data module within the plug connector housing or within the adaptor module, and that its data may still be addressed irrespective of the conventional cabling of the plug connector. In particular, it is thus also possible to exchange data in a bidirectional manner. The data module may generate, receive, store and/or process data from measured values that are obtained within the plug connector and also to output said data via one or various ports. As an alternative or in addition thereto, the data module may store an identification code and/or specific data relating to the respective plug connector and/or connected devices.

It is of particular advantage that it is also possible to configure the data transmission from a shielding, by way of example metal, plug connector housing without the housing requiring for this purpose a modification that could otherwise impair the shielding effect.

A particular advantage of the invention resides in the fact that it is possible by using an adaptor module to retrofit existing housings that are already well-established in the market. As a consequence, it is possible to modify existing modules in a cost-effective manner. It is also of a great economic advantage that the production process of corresponding housings may remain unchanged.

In a preferred embodiment, the cable gland comprises a screw thread.

It is possible using such a screw thread to screw such a cable gland generally directly in or onto a corresponding mating thread of the preferably circular cable outlet opening of the plug connector housing, in the event that the respective application by way of example does not require an adaptor module. The cable gland naturally comprises a cable passage opening that is provided for guiding through a cable, and comprises furthermore means that are suitable for fixing the cable during the insertion procedure, with the result that the cable is generally held in a stable manner against the plug connector so as to provide strain relief.

However, it is also possible in accordance with the invention for the adaptor module to comprise a screw thread at its preferably circular cable inlet opening, in particular at its hollow cylindrical cable inlet connection piece and it is possible using said screw thread to screw said adaptor module into or onto the said mating thread of the plug connector housing.

Furthermore, the adaptor module may comprise a cable passage region that lies adjacent to the cable inlet opening and the cable may be guided through said cable passage region. The adaptor module comprises a preferably circular cable outlet opening at the opposite-lying end of this cable passage opening. Said preferably circular cable outlet opening may be by way of example a hollow cylindrical cable outlet connection piece and likewise comprise a screw thread into or on which it is possible to screw the said—or also another—cable gland.

If the diameter and the thread shape of the cable outlet opening of the adaptor module match those of the plug connector, this is of advantage, the reason being that it is consequently possible to use the same cable gland that is also provided for the conventional use of the plug connector and this simplifies the production process and also reduces costs.

However, the structural shape of the adapter module may necessitate that by way of example the diameter of its cable inlet opening differs from the diameter of the cable outlet opening of the plug connector housing, for example is smaller than the diameter of said cable outlet opening. In this case, the adaptor module may comprise a dedicated cable gland that is tailored specifically to suit its structure shape, which is advantageous if said cable gland is to be tailored to suit the exact structural conditions of the adaptor module and is thus able to provide a particularly good magnitude of stability.

It is possible in each of these cases for the adaptor module to be screwed to the plug connector housing and for the respective cable gland to be screwed to the adaptor module. This is of advantage, because the adaptor module is thus held in a stable manner between the plug connector housing and the cable gland.

It is naturally also possible to transmit data to the environment of the plug connector via the conventional cable that is guided through the cable outlet opening of the adaptor module out of said adaptor module. However, as already mentioned, the path of this cable limits the extent to which the data may be addressed.

In contrast, the invention has the advantage that, in addition to the conventional functionality of the plug connector, the adaptor module also provides a functional extension that renders possible a separate data output and in particular is even used to provide a separate data exchange that may be freely addressed irrespective of the conventional cabling.

The adaptor module advantageously comprises for this purpose in addition to the said cable outlet opening, further means for outputting data, by way of example one or a plurality of optical display devices, such as for example a display or one or a plurality of in particular different colored LEDs (light emitting diodes). This has the advantage that signals may be optically recognized immediately without the need for further means. On the one hand, this means a reduction in costs and on the other hand also less susceptibility to failure than for example via a radio connection. By way of example, it is possible for this to be displayed in this manner by a plug connector whose proper function is no longer reliably ensured, for example as a result of heat or humidity. This may be simply recognized by appropriately trained personnel, by way of example in the railway industry, and the plug connector may consequently be changed promptly, which is of a particularly large advantage for the operational safety of the corresponding system, by way of example of an industrial plant, a railway or similar.

In addition or as an alternative thereto, the further means for outputting data may comprise one or a plurality of digital interfaces. This has the advantage that the corresponding data may be evaluated in particular in real time. In particular, the data may be transmitted on line, for example via a network, by way of example also via the internet to a computer and evaluated centrally. In this case, a bidirectional data exchange is also possible, with the result that by way of example the computer may also provide the data module with instructions, by way of example specific measurements at specific points in time.

Furthermore, it is advantageous if at least one of the interfaces is suitable outputting data via a wireless radio connection, because this reduces the corresponding cabling outlay. By way of example, the interface may be a USB-interface, to which it is possible to connect so-called "dongles", in other words special USB-sticks that comprise by way of example communication modules. These communication modules may be in particular radio modules that use standards such as for example Zig Bee, WLAN, RFID and/or Bluetooth.

It is particularly advantageous if means are provided so as to ensure the energy supply to such a radio module. It is possible for this purpose to connect at least one connection of the at least one interface in an electrically conductive manner to at least one line of the conventional cable, by way of example a so-called POE (power over Ethernet) line.

However, it is possible as an alternative or in addition thereto to also connect an additional cable, namely a communication cable, directly to at least one of these interfaces, which inter alia has the advantage that the data security of the transmission is increased in contrast to a radio connection. The interfaces may be by way of example USB, RJ45 and/or M6 plug connection interfaces or the like. Visual modules that comprise LED lamps or displays may also be connected to these interfaces. In this case, the electrical energy supply to the modules may be realized via the communication cable.

In a further preferred embodiment, the data module is arranged in the adaptor module. As a consequence, installation space is created in the plug connector housing for its conventional components/plug connector modules, which represents an additional advantage.

BRIEF DESCRIPTION OF THE DRAWINGS

An exemplary embodiment of the invention is illustrated in the drawings and further explained below. In the drawings.

The figures show in part simplified, schematic illustration. In part, identical reference numerals are used for like but where appropriate non-identical elements. Different views of like elements could be scaled differently.

DETAILED DESCRIPTION OF THE INVENTION

Figure 1:
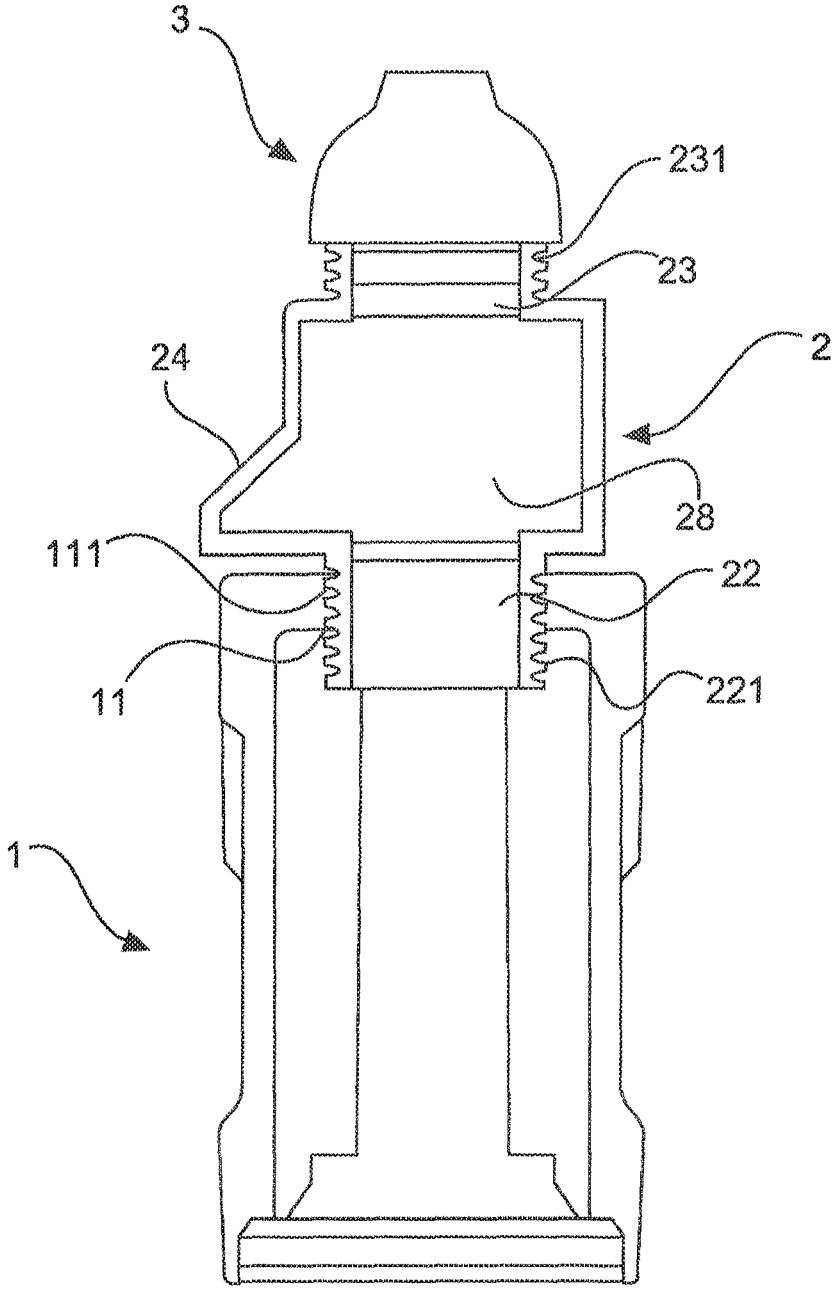
FIG. 1 illustrates a plug connector housing having an adaptor module and a cable gland.

FIG. 1 illustrates a plug connector housing 1 having a cable outlet opening 11 that comprises an inner thread 111.

Furthermore, an adaptor module 2 is illustrated that comprises a cable inlet opening in the form of a hollow cylindrical cable inlet connection piece 22 having an outer thread 221. The outer thread 221 is used to screw the adaptor module 2 with its cable inlet connection piece 22 into the inner thread 111 of the cable outlet opening 11. Furthermore, the adaptor module 2 comprises a cable outlet opening that is configured in this example in the form of a hollow cylindrical cable outlet connection piece 23. This cable outlet connection piece 23 comprises an outer thread 231.

The adaptor module 2 comprises a cable passage region 28 between the cable inlet connection piece 22 and the cable outlet connection piece 23.

Furthermore, a cable gland 3 is illustrated that comprises an inner thread that is not visible in the drawing and may be used to screw said cable gland onto the cable outlet connection piece 23.

As an alternative thereto, the cable outlet connection piece 23 could also comprise an inner thread and the cable gland 3 could comprise an outer thread, with which it would be possible to screw said cable gland into the cable outlet connection piece 11.

In particular, the adaptor module 2 comprises an outlet surface 24 in which it is possible to arrange means for outputting data and/or signals.

Figure 2A:
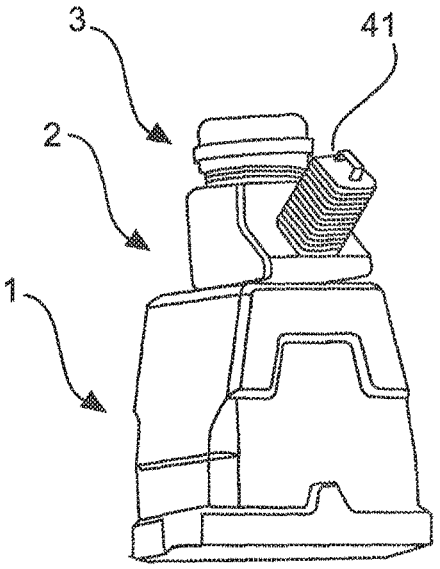
FIG. 2*a,b,c* illustrates a plug connector having an adaptor module, a cable gland and a radio dongle.

FIG. 2*a* illustrates a plug connector housing 1 having an adaptor module 2 and a cable gland 3, wherein a radio dongle 41 is plugged onto the outlet surface 24.

Figure 2B:
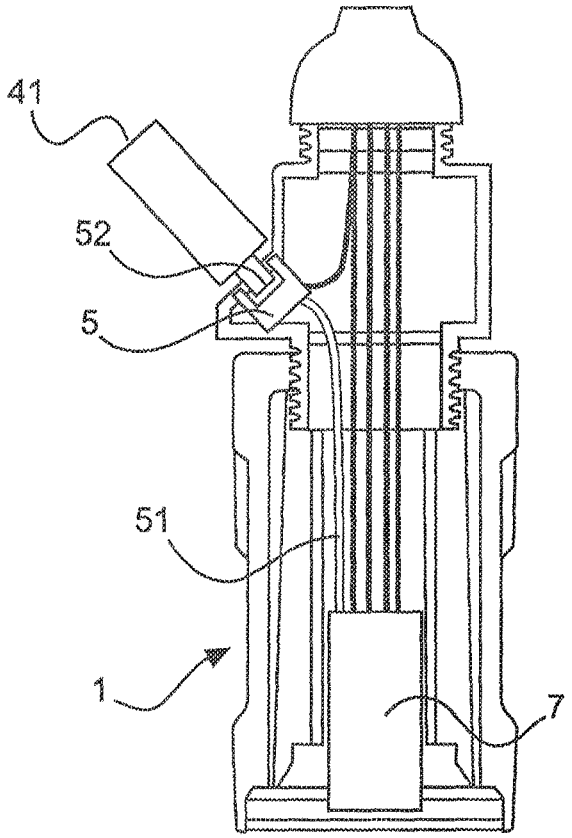

FIG. 2*b* illustrates a cross-sectional view of the same arrangement and clearly illustrates the corresponding cabling arrangement. A conventional cable 6 (see FIG. 2*c*) passes through the cable gland 3 and is screwed by means of said cable gland to the adaptor module 2. The adaptor module 2 comprises a data module 5 that is arranged on its outlet surface 24 and comprises a dedicated interface 52, for example a USB-interface. It is naturally possible for each dongle that matches the interface 52 to be plugged into the data module 5, in particular the radio dongle 41 that is illustrated in the figure. In particular, this interface 52 should also ensure a current supply. This current is supplied via a supply line 61 that originates from the cable 6 or is connected in an electrically conductive manner to a corresponding line of the cable 6.

Figure 2C:
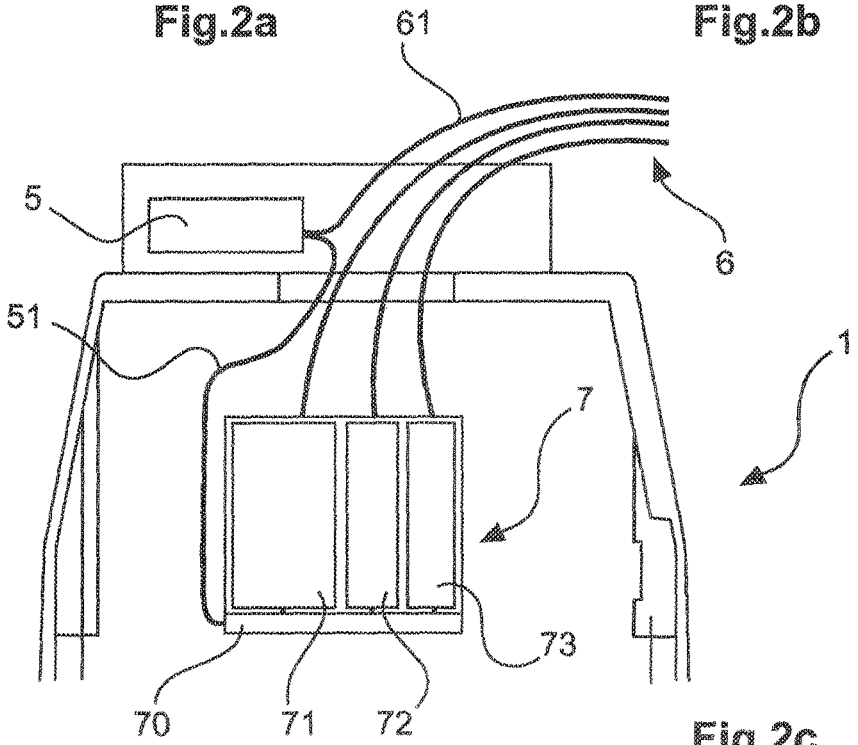

As is illustrated in FIG. 2*c*, three conventional plug connector modules 7 are arranged in the plug connector housing 1, namely an electrical module 71 for transmitting electrical energy, an optical module 72 for transmitting optical signals and a pneumatic module 73 for transmitting air or air pressure.

Furthermore, FIG. 2*c* also illustrates a bus system 70 that connects the plug connector modules 71, 72, 73 in an electrical manner to one another via their switching contacts that are not illustrated and said bus system is connected via a data line 51 to the data module 5 and the associated interface 251. Current may also be supplied to the bus system 70 and if necessary to a corresponding sensor system within the modules 71,72, 73 likewise via the data line 51 and via the interface 251 and consequently from the supply line 61.

Figure 3A:
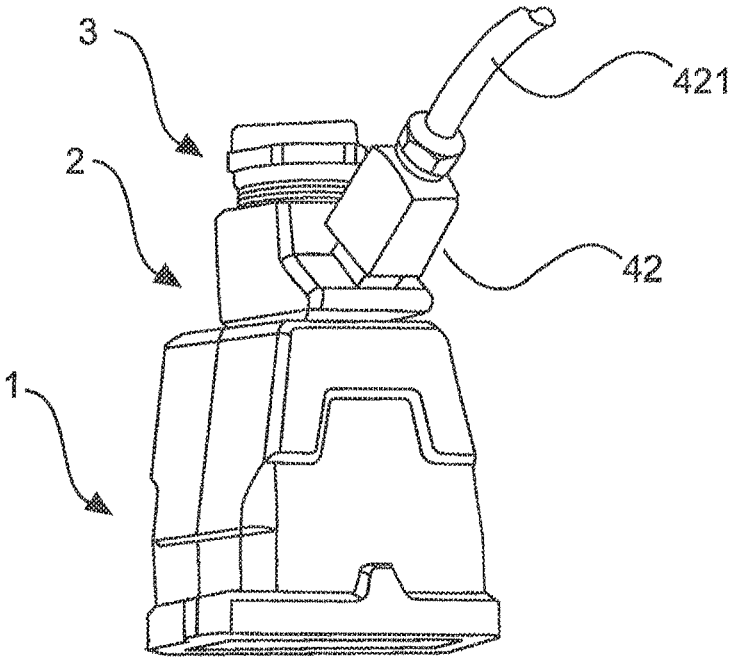
FIG. 3*a,b* illustrates a plug connector housing having an adaptor module, a cable gland and a push-pull plug connection.
Figure 3B:
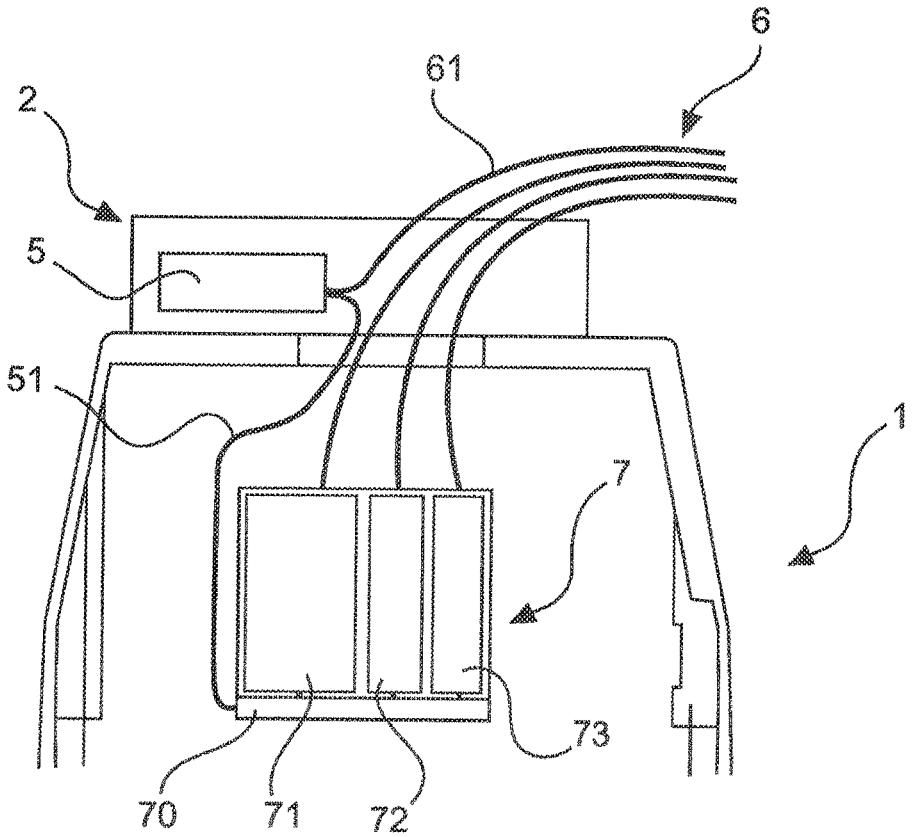

The data module 5 in FIG. 3*a* and FIG. 3*b* is fitted with a plug connection that does not require a current supply from the cable 6 since said plug connection is provided so as to be connected to a cable-connected plug connector, in particular a push-pull plug connector 42 that for its part is connected at the cable connection end to a data cable 421.

Accordingly, the plug connection of the data module 5 is a so-called "push-pull plug connection that may be operated together with the corresponding push-pull plug connector 42. The plug connection of the data module 5 may be connected to the bus system 70 via the data line 51. If necessary, the data module 5 may also be supplied with electrical energy via this data line 51 and consequently via the push-pull plug connector 42 and its data cable 421.

Figure 4A:
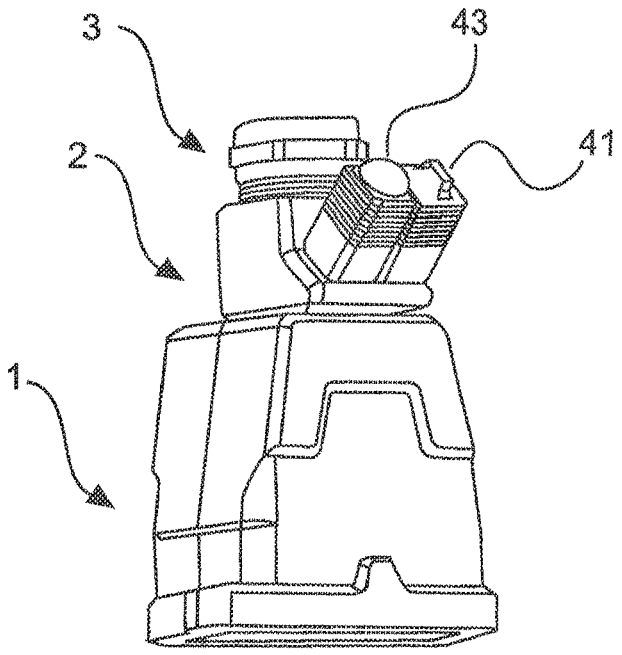
FIG. 4*a,b* illustrates a plug connector housing having an adaptor module, a cable gland and a radio dongle and an LED dongle.
Figure 4B:
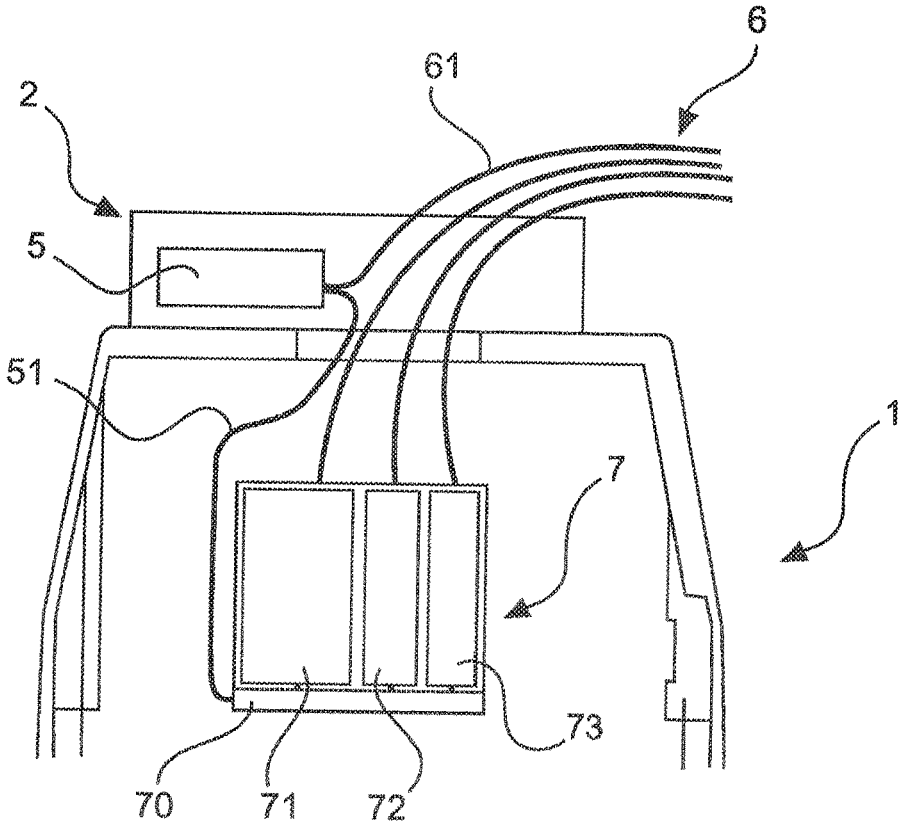

FIG. 4*a* illustrates an arrangement in which the adaptor module 2 comprises a data module 5 having a plurality, namely in this case two, interfaces. It is consequently possible, as illustrated, to connect even two different dongles 4 to the data module. In this case, this is the already described radio dongle 41 and an additional LED dongle 43 that is characterized by the fact that it comprises one or a plurality of LEDs (light emitting diodes) that it may use directly as an optical signal transmitter.

Figure 5A:
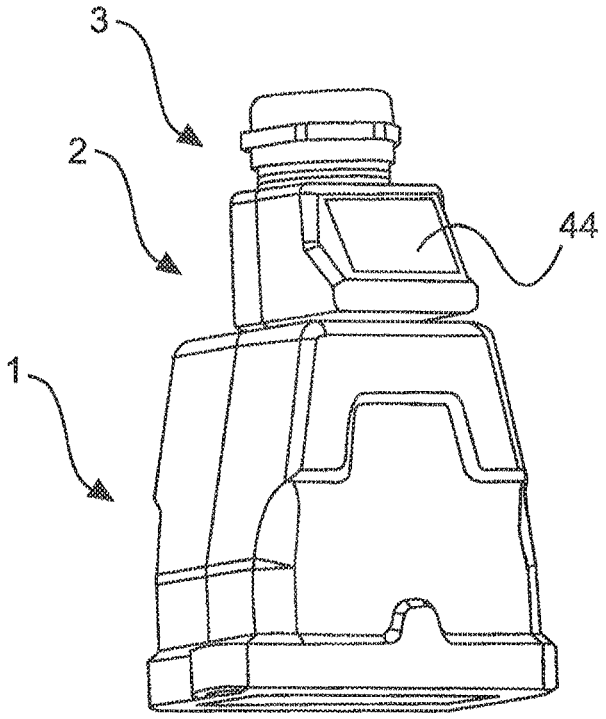
FIG. 5*a,b* illustrates a plug connector housing having an adaptor module, which comprises an optical display device, and a cable gland.
Figure 5B:
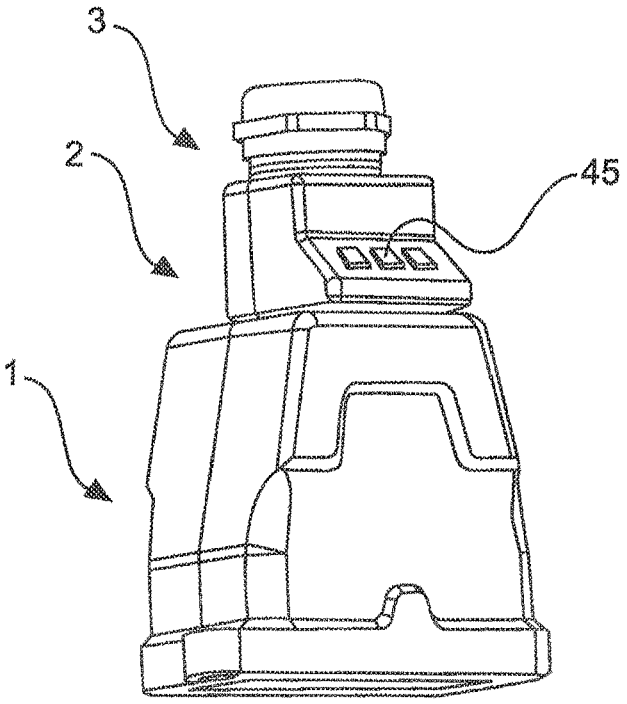

FIG. 5*a* and FIG. 5*b* illustrate adaptor modules that for their part comprise a corresponding display device.

The adaptor module 2 in FIG. 5*a* comprises a display 44 that has the advantage that its display function may be freely programmed by the user.

The adaptor module in FIG. 5*b* comprises a plurality of different colored LEDs that may display specific conditions in an easily visible manner by means of correspondingly colored signals.

LIST OF REFERENCE NUMERALS

1 Plug connector housing
11 Cable outlet opening
111 Inner thread of cable outlet opening
2 Adaptor module
22 Cable inlet opening/Cable inlet connection piece
221 Outer thread of the cable inlet connection piece
23 Cable outlet opening/Cable outlet connection piece
231 Outer thread of the cable outlet connection piece
24 Outlet surface
28 Cable passage region
3 Cable gland
41 Radio dongle
42 Push-pull plug connector
421 Data cable
43 LED dongle
44 Display
45 LED display
5 Data module
51 Data line
52 Interface
6 Conventional cable
61 Supply line
7 Plug connector modules
70 Bus system
71 Electrical module
72 Optical module
73 Pneumatic module

The invention claimed is:

1. A device for data transmission, said device comprising a data module for storing and playing back data, and also a plug connector housing having a cable outlet opening and a cable gland, wherein the device comprises furthermore an adaptor module that comprises at least one cable passage region and that the adaptor module comprises a cable inlet opening at a first end of this cable passage region and a cable outlet opening at a second end of this cable passage region, wherein the adaptor module may be fastened through its cable inlet opening to the cable outlet opening of the plug connector housing, and the cable gland may be fastened to the cable outlet opening of the adaptor module, with the result that the adaptor module may be fastened between the cable outlet opening and the cable gland, and further wherein the adaptor module comprises in addition to the cable outlet opening a further outlet for outputting data.

2. The device for data transmission as claimed in claim 1, wherein the adaptor module comprises at its cable inlet opening and its cable outlet opening a screw thread respectively, and that the plug connector housing and also the cable gland each comprise a corresponding mating thread.

3. The device as claimed in claim 2, wherein the cable inlet opening is configured in the form of a hollow cylindrical cable inlet connection piece and the corresponding screw thread is arranged on said cable inlet connection piece.

4. The device as claimed in claim 3, wherein the screw thread of the cable inlet connection piece is an outer thread that may be screwed into an inner thread of the plug connector housing.

5. The device as claimed in claim 4, wherein the data module is arranged in the adapter module.

6. The device as claimed in claim 2, wherein the data module is arranged in the adapter module.

7. The device as claimed in claim 3, wherein the data module is arranged in the adapter module.

8. The device as claimed in claim 1, wherein the further outlet for outputting data comprises an optical display device.

9. The device as claimed in claim 8, wherein the data module is arranged in the adapter module.

10. The device as claimed in claim 1, wherein the further outlet for outputting data comprises one or a plurality of digital interfaces.

11. The device as claimed in claim 10, wherein at least one of the interfaces is suitable for outputting data via a wireless radio connection.

12. The device as claimed in claim 11, wherein the at least one interface is suitable for connecting a radio module and that the device comprises a connector for connecting a connection of this interface in an electrically conductive manner to at least one line of the first cable so as to ensure the energy supply to such a radio module.

13. The device as claimed in claim 12, wherein the data module is arranged in the adapter module.

14. The device as claimed in claim 10, wherein the data module is arranged in the adapter module.

15. The device as claimed in claim 11, wherein the data module is arranged in the adapter module.

16. The device as claimed in claim 1, wherein the data module is arranged in the adaptor module.

* * * * *